US012145775B2

(12) United States Patent
Zhang et al.

(10) Patent No.: US 12,145,775 B2
(45) Date of Patent: Nov. 19, 2024

(54) STORAGE BOX COVER AND STORAGE BOX USED THEREWITH

(71) Applicant: Hebei Fenger Intelligent Technology Co. , Ltd., Shijiazhuang (CN)

(72) Inventors: Jianzhong Zhang, Handan (CN); Xiaojia Liu, Handan (CN)

(73) Assignee: HEBEI FENGER INTELLIGENT TECHNOLOGY CO., LTD., Shijiazhuang (CN)

( * ) Notice: Subject to any disclaimer, the term of this patent is extended or adjusted under 35 U.S.C. 154(b) by 99 days.

(21) Appl. No.: 17/701,720

(22) Filed: Mar. 23, 2022

(65) Prior Publication Data

US 2022/0212837 A1 Jul. 7, 2022

(51) Int. Cl.

| | |
|---|---|
| ***B65D 43/02*** | (2006.01) |
| ***B65D 21/02*** | (2006.01) |
| ***B65D 51/16*** | (2006.01) |
| ***B65D 51/24*** | (2006.01) |

(52) U.S. Cl.

CPC ..... *B65D 43/0204* (2013.01); *B65D 21/0222* (2013.01); *B65D 51/1683* (2013.01); *B65D 51/242* (2013.01); *B65D 2543/00027* (2013.01); *B65D 2543/00101* (2013.01); *B65D 2543/00842* (2013.01)

(58) Field of Classification Search

CPC ..... B65D 21/0222; B65D 21/0223; B65D 51/1683; B65D 2543/00027; B65D 21/022; B65D 21/0217; B65D 21/0219; B65D 21/0209

See application file for complete search history.

(56) References Cited

U.S. PATENT DOCUMENTS

| | | | | |
|---|---|---|---|---|
| 2009/0173656 | A1* | 7/2009 | Furlong | B65D 21/0233 206/508 |
| 2011/0000919 | A1 | 1/2011 | Whalen | |
| 2014/0124515 | A1 | 5/2014 | Kabe et al. | |
| 2017/0210512 | A1 | 7/2017 | Fulton et al. | |
| 2018/0265263 | A1* | 9/2018 | Li | B65D 43/0202 |
| 2019/0352046 | A1* | 11/2019 | Pohlman | B65D 85/36 |

* cited by examiner

*Primary Examiner* — Jeffrey R Allen

(74) *Attorney, Agent, or Firm* — Hemisphere Law, PLLC; Zhigang Ma

(57) ABSTRACT

The present invention discloses a storage box cover and a storage box used therewith. The storage box cover is covered on a storage box body which is fixedly connected with a clamping convex ring on a bottom end surface; the top edge of a cover body is annularly provided with a clamping groove; the bottom end surface of the cover body is annularly provided with a buckle; the top circumference of the cover body has a downward turnup; a ring groove for clamping the top of the storage box body is formed between the buckle and the turnup; and the buckle can be adapted and clamped in the clamping groove to complete the stable stacking of a plurality of storage box covers; the top of the cover body is fixedly connected with a limiting flange for limiting the storage box body.

8 Claims, 5 Drawing Sheets

STORAGE BOX COVER AND STORAGE BOX USED THEREWITH

TECHNICAL FIELD

The present invention relates to a storage tool, in particular to a storage box cover and a storage box used therewith.

BACKGROUND

Storage boxes and storage box covers are used when articles are stored in daily life. When many articles need to be stored, a plurality of storage boxes and a plurality of storage box covers are required, but the existing storage box covers or storage boxes are unstable after stacked, and easy to collapse and cause loss after collided. A plurality of idle storage boxes and storage box covers are inconvenient in stacking, and occupy the space.

Therefore, the problem to be urgently solved by those skilled in the art is how to provide a storage box cover and a storage box used therewith for stable stacking of a plurality of storage boxes.

SUMMARY

In view of this, the present invention provides a storage box cover and a storage box used therewith. The storage box cover can be covered on a storage box body. When storage boxes are stacked on the storage box cover, the storage boxes are stable in stacking and difficult to fall, and saves the placement area.

To achieve the above purpose, the present invention adopts the following technical solution: a storage box cover is covered on a storage box body which is fixedly connected with a clamping convex ring on a bottom end surface; the top edge of a cover body is annularly provided with a clamping groove; the bottom end surface of the cover body is annularly provided with a buckle; the top circumference of the cover body has a downward turnup; a ring groove for clamping the top of the storage box body is formed between the buckle and the turnup; and the buckle can be adapted and clamped in the clamping groove to complete the stable stacking of a plurality of storage box covers; the top of the cover body is fixedly connected with a limiting flange for limiting the storage box body; the top of the cover body is provided with an anti-slip convex strip near the edge of one end; and the limiting flange and the anti-slip convex strip are used for clamping the clamping convex ring and limiting the stable stacking of the box body.

The present invention has the following beneficial effects: when a plurality of storage box covers are matched with the storage box body, a plurality of individual storage box covers can be stacked. Specifically, the clamping groove formed on the top of the lower cover body of the storage box is matched with the buckle arranged on the bottom of the upper cover body to realize the stable stacking of the upper and lower layers of the plurality of cover bodies. When the storage box body and the storage box covers are used together, a plurality of storage boxes in use can be stacked, and the storage boxes can be stably placed on the cover bodies of the storage boxes. Specifically, the top of the cover body is fixedly connected with the limiting flange for limiting the storage box body; the top of the cover body is provided with the anti-slip convex strip near the edge of one end; and the limiting flange and the anti-slip convex strip are used for clamping the clamping convex ring on the bottom of the storage box body and limiting the stable stacking of the storage box body. The storage boxes are difficult to fall and stable in placement.

Preferably, the middle part of the cover body is provided with an air hole penetrating through upper and lower end surfaces, and the air hole is adapted and connected with an air hole plug.

Preferably, the outer side wall of the turnup is integrally fixed with a handle convenient to open the cover body.

Preferably, the limiting flange is a door-shaped structure; two opposite parallel inner side walls of the limiting flange form a slideway; the clamping convex ring is a rectangular structure; and two parallel outer side walls of the clamping convex ring are slidably connected with the slideway.

Preferably, the anti-slip convex strip is positioned at an opening of the limiting flange.

Preferably, a chute is formed on the slideway; two opposite parallel outer side walls of the clamping convex ring are connected with a sliding strip; and the sliding strip is adapted and slidably connected to the chute.

The present invention further discloses a storage box, comprising the storage box cover and the storage box body; the outer side of the top edge of the storage box body is annularly provided with a side wing plate; the clamping convex ring is adapted and clamped on the inner side of the limiting flange; and the anti-slip convex strip is clamped with the outer side wall of one end of the clamping convex ring.

1 storage box body; 2 cover body; 3 clamping convex ring; 4 clamping groove; 5 buckle; 6 turnup; 7 ring groove; 8 limiting flange; 9 anti-slip convex strip; 10 air hole; 11 air hole plug; 12 handle; 13 side wing plate.

DETAILED DESCRIPTION

The technical solution in the embodiments of the present invention will be clearly and fully described below in combination with the drawings in the embodiments of the present invention. Apparently, the described embodiments are merely part of the embodiments of the present invention, not all of the embodiments. Based on the embodiments in the present invention, all other embodiments obtained by those ordinary skilled in the art without contributing creative labor will belong to the protection scope of the present invention.

Figure 1:
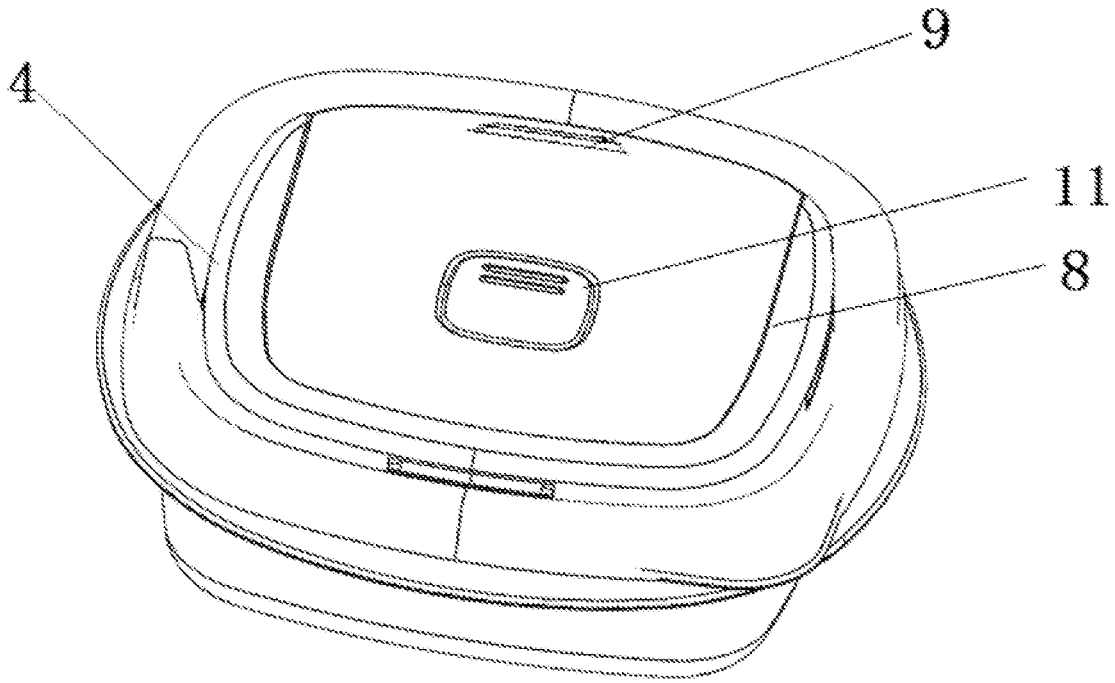
FIG. 1 is an entire schematic diagram 1 of a storage box cover and a storage box used therewith in the present invention.
Figure 2:
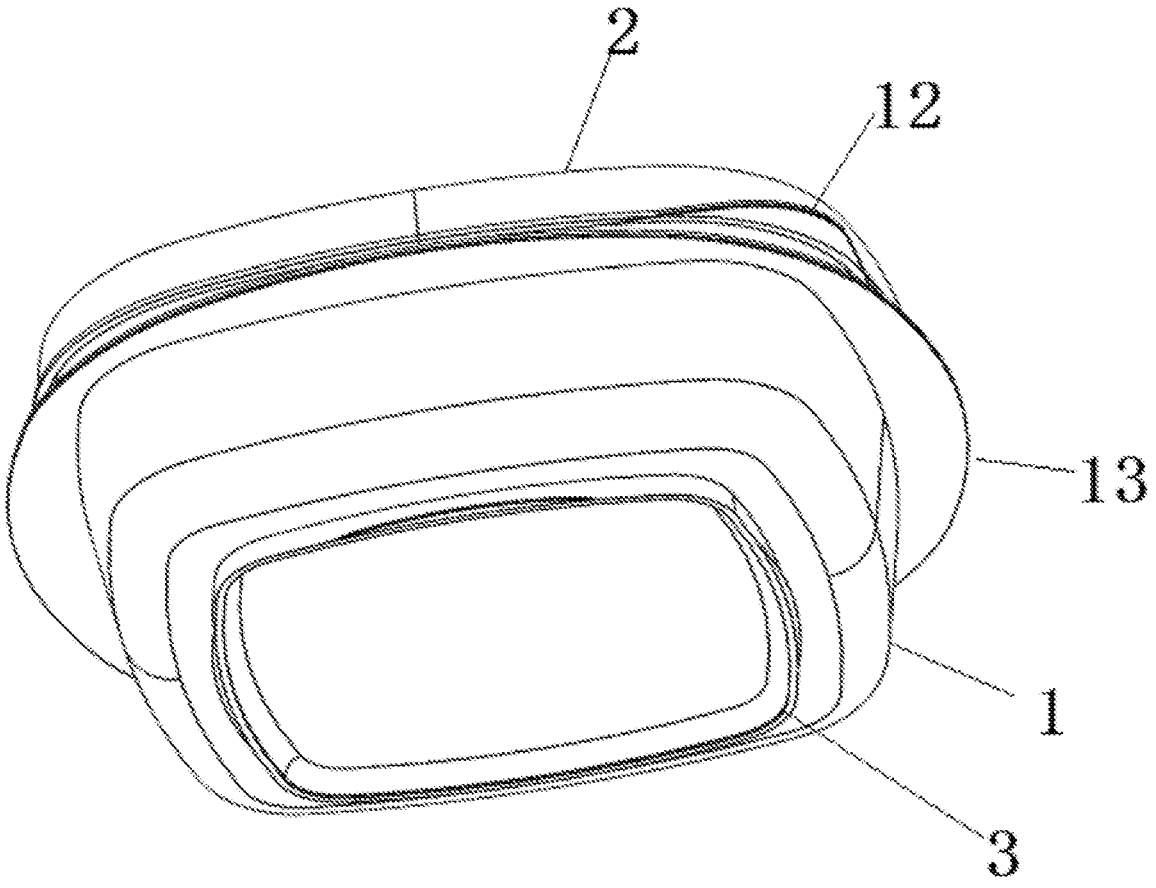
FIG. 2 is an entire schematic diagram 2 of a storage box cover and a storage box used therewith in the present invention.
Figure 3:
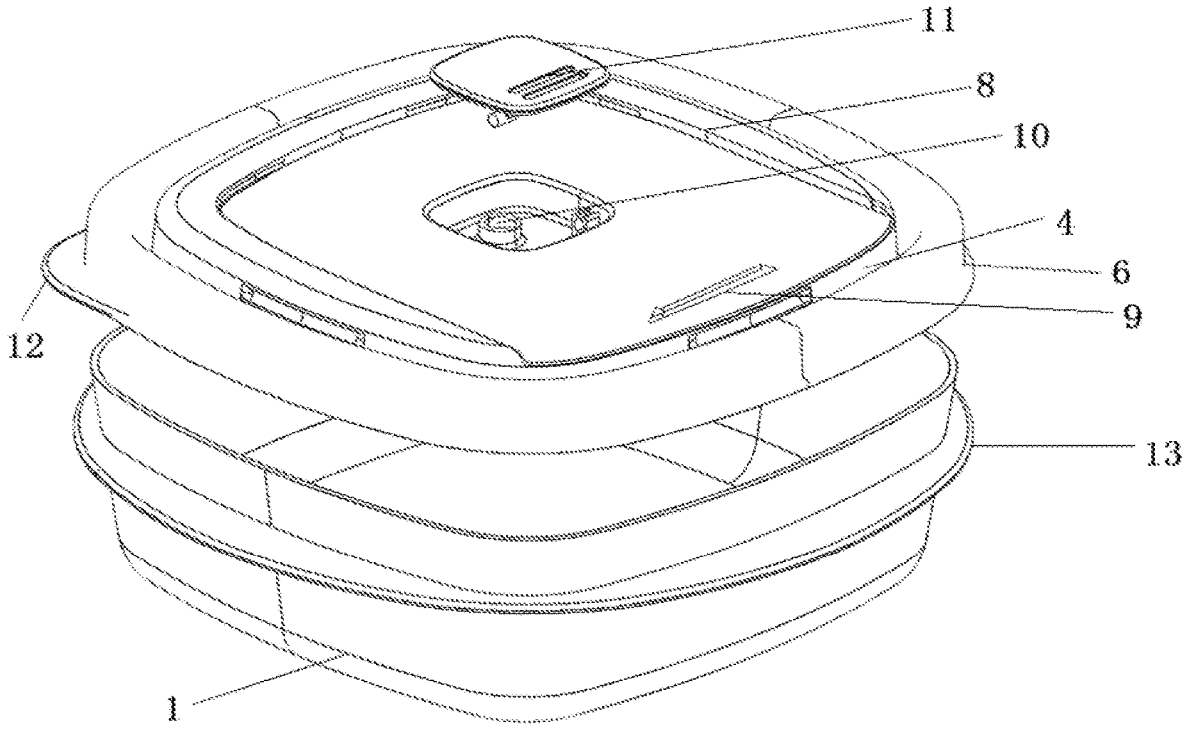
FIG. 3 is an entire assembly schematic diagram of a storage box cover and a storage box used therewith in the present invention.
Figure 4:
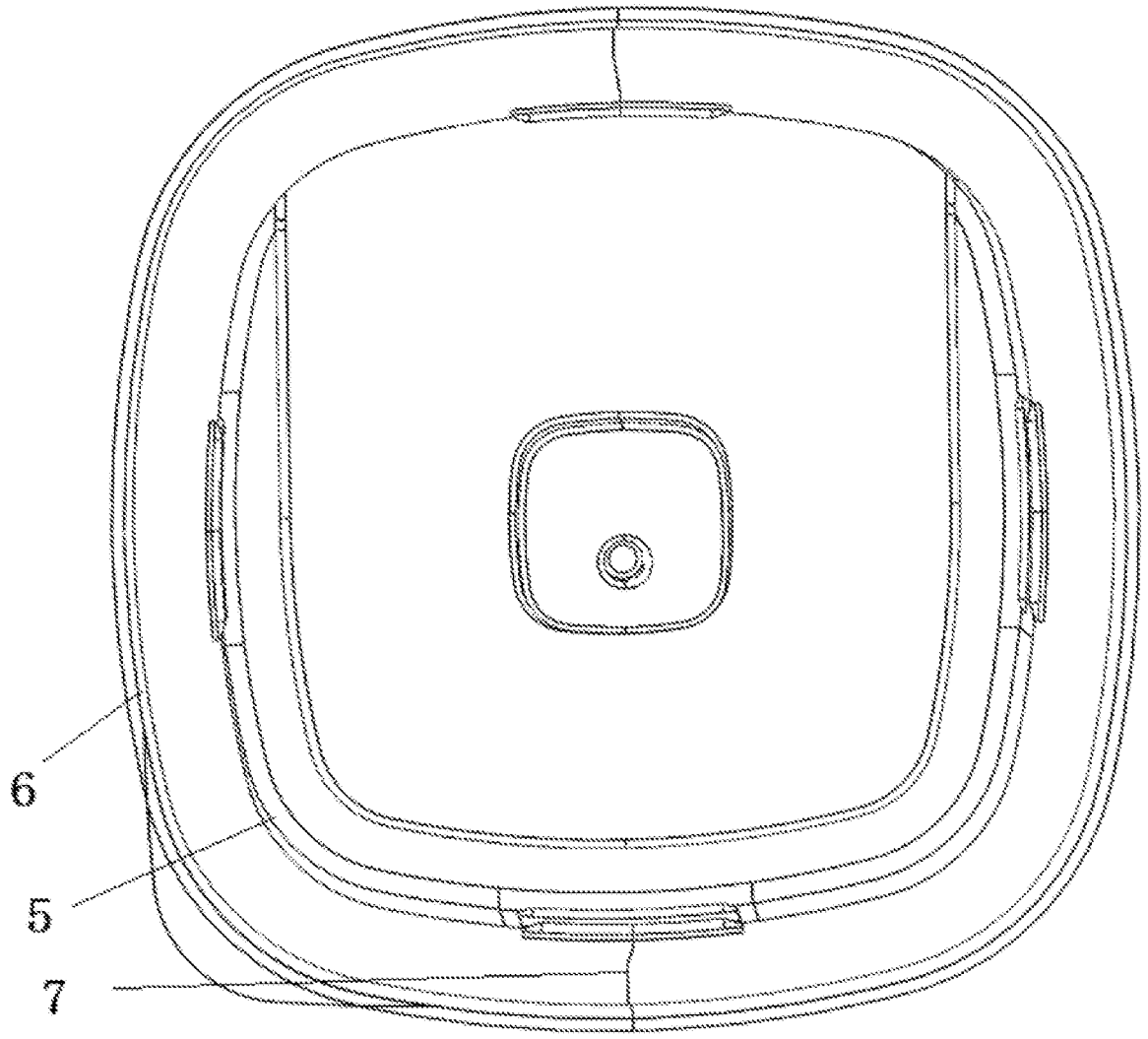
FIG. 4 is a bottom schematic diagram of a cover body of a storage box cover and a storage box used therewith in the present invention.
Figure 5:
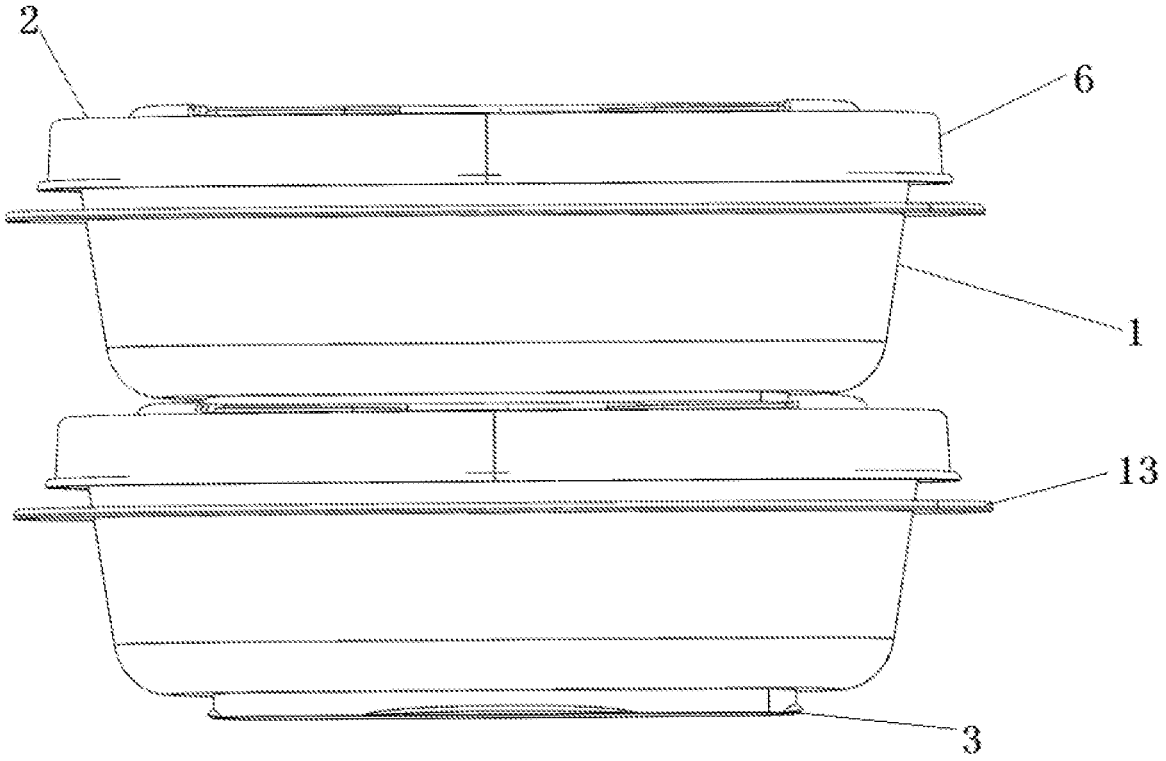
FIG. 5 is a schematic diagram of stacking of box bodies of a storage box cover and a storage box used therewith in the present invention.
Figure 6:
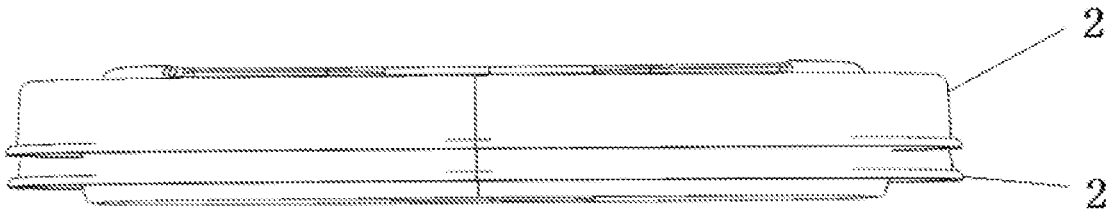
FIG. 6 is a schematic diagram of stacking of cover bodies of a storage box cover and a storage box used therewith in the present invention.

By referring to FIGS. 1-6 of the present invention, a storage box cover according to embodiments of the present invention is covered on a storage box body 1 which is fixedly connected with a clamping convex ring 3 on a bottom end surface; the top edge of a cover body 2 is annularly provided with a clamping groove 4; the bottom end surface of the cover body 2 is annularly provided with a buckle 5; the top circumference of the cover body 2 has a downward turnup 6; a ring groove 7 for clamping the top of the storage box body is formed between the buckle 5 and the turnup 6; and the buckle 5 can be adapted and clamped in the clamping groove 4 to complete the stable stacking of a plurality of storage box covers; the top of the cover body 2 is fixedly connected with a limiting flange 8 for limiting the storage box body; the top of the cover body 2 is provided with an anti-slip convex strip 9 near the edge of one end; and the limiting flange 8 and the anti-slip convex strip 9 are used for clamping the clamping convex ring 3 and limiting the stable stacking of the box body.

A plurality of individual storage box covers can be adapted and stacked. A plurality of individual storage box bodies can be stacked. When the plurality of individual storage box bodies are stacked, the bottom calibers of the storage box bodies shall be gradually reduced.

When storage box covers are covered on and matched with the storage box bodies, a plurality of matched storage boxes can be stacked up and down. At this moment, the storage box bodies are put on the lower storage box cover. Because the cover body is provided with the limiting flange and the anti-slip convex strip, the clamping convex ring arranged on the bottom end surface of the storage box bodies can be stably limited to ensure that the upper storage box body is placed stably and not easy to fall.

In some other embodiments, the middle part of the cover body 2 is provided with an air hole 10 penetrating through upper and lower end surfaces, and the air hole 10 is adapted and connected with an air hole plug 11. It is beneficial to temperature control and food preservation.

In some other embodiments, the outer side wall of the turnup 6 is integrally fixed with a handle 12 convenient to open the cover body. It is convenient for use.

In some other embodiments, the limiting flange 8 is a door-shaped structure; two opposite parallel inner side walls of the limiting flange 8 form a slideway; the clamping convex ring 3 is a rectangular structure; and two parallel outer side walls of the clamping convex ring are slidably connected with the slideway. The upper storage box body can slide onto the lower storage box cover.

Specifically, the anti-slip convex strip 9 is positioned at an opening of the limiting flange 8.

The present invention further discloses a storage box, comprising the storage box cover and the storage box body; the outer side of the top edge of the storage box body 1 is annularly provided with a side wing plate 13, which is convenient for holding; the clamping convex ring 3 is adapted and clamped on the inner side of the limiting flange 8; and the anti-slip convex strip 9 is clamped with the outer side wall of one end of the clamping convex ring 3. The upper storage box body is ensured to be plated stably.

In the present invention, when the storage box covers are stacked, the buckle of the upper cover can correspond to the clamping groove of the lower cover, so that the covers will not fall when stacked, thereby saving the space and facilitating the storage.

When the storage boxes are stacked together, the clamping convex ring below the storage box can push the storage box along the two inner slideways of the limiting flange on the cover, and enter the storage box cover along the slideways. The anti-slip convex strip on the box cover can prevent the storage box body from falling and slipping. It is convenient for storage and placement of the storage box, and convenient for use.

In some other embodiments, for stable connection between the upper storage box and the lower cover, a chute can be formed on the slideway; two opposite parallel outer side walls of the clamping convex ring are provided with a sliding strip; and the sliding strip is slidably connected to the chute, so that the connection between the upper storage box and the lower cover is stable.

For a device and a use method disclosed by the embodiments, because the device and the use method correspond to a method disclosed by the embodiments, the device and the use method are simply described. Refer to the description of the method part for the related part.

The above description of the disclosed embodiments enables those skilled in the art to realize or use the present invention. Many modifications to these embodiments will be apparent to those skilled in the art. The general principle defined herein can be realized in other embodiments without departing from the spirit or scope of the present invention. Therefore, the present invention will not be limited to these embodiments shown herein, but will conform to the widest scope consistent with the principle and novel features disclosed herein.

What is claimed is:

1. A storage box cover, covered on a storage box body (1) which is fixedly connected with a clamping convex ring (3) on a bottom end surface, wherein the storage box cover comprises a cover body (2); a top edge of the cover body (2) is annularly provided with a clamping groove (4); a bottom end surface of the cover body (2) is annularly provided with a buckle (5); a top circumference of the cover body (2) has a downward turnup (6); a ring groove (7) for clamping the top of the storage box body is formed between the buckle (5) and the turnup (6); and the buckle (5) can be adapted and clamped between two opposite sidewalls defining the clamping groove (4) to complete the stable stacking of a plurality of storage box covers; a top of the cover body (2) is fixedly connected with a limiting flange (8); the top of the cover body (2) is provided with an anti-slip convex strip (9) near an edge of one end; and the limiting flange (8) and the anti-slip convex strip (9) are used for clamping the clamping convex ring (3) to ensure the stable stacking of the box body;

the limiting flange (8) is a U-shaped structure and comprises a bottom wall and two opposite parallel inner side walls extending out from two opposite ends of the bottom wall respectively; the two opposite parallel inner side walls of the limiting flange (8) form a slideway; the clamping convex ring (3) is a rectangular structure; and two parallel outer side walls of the clamping convex ring are configured to be slidably connected with the slideway, the anti-slip convex strip (9) is positioned at an opening of the U-shaped structure, when the clamping convex ring slides inside the U-shaped structure, the anti-slip convex strip (9) resists against an outer side wall of the clamping convex ring (3).

2. The storage box cover according to claim 1, wherein a middle part of the cover body (2) is provided with an air hole (10) penetrating through upper and lower end surfaces, and the air hole (10) is adapted and connected with an air hole plug (11).

3. The storage box cover according to claim 2, wherein an outer side wall of the turnup (6) is integrally fixed with a handle (12) convenient to open the cover body.

4. The storage box cover according to claim 1, wherein a chute is formed on the slideway; two opposite parallel outer side walls of the clamping convex ring (3) are connected with a sliding strip; and the sliding strip is adapted and slidably connected to the chute.

5. A storage box, comprising the storage box cover of claim 1 and the storage box body, wherein an outer side of the top edge of the storage box body (1) is annularly provided with a side wing plate (13); the clamping convex ring (3) is adapted and clamped on an inner side of the limiting flange (8); and the anti-slip convex strip (9) is clamped with an outer side wall of one end of the clamping convex ring (3).

6. A storage box, comprising the storage box cover of claim 2 and the storage box body, wherein an outer side of the top edge of the storage box body (1) is annularly provided with a side wing plate (13); the clamping convex ring (3) is adapted and clamped on an inner side of the limiting flange (8); and the anti-slip convex strip (9) is clamped with an outer side wall of one end of the clamping convex ring (3).

7. A storage box, comprising the storage box cover of claim 3 and the storage box body, wherein an outer side of the top edge of the storage box body (1) is annularly provided with a side wing plate (13); the clamping convex ring (3) is adapted and clamped on an inner side of the limiting flange (8); and the anti-slip convex strip (9) is clamped with an outer side wall of one end of the clamping convex ring (3).

8. A storage box, comprising the storage box cover of claim 4 and the storage box body, wherein an outer side of the top edge of the storage box body (1) is annularly provided with a side wing plate (13); the clamping convex ring (3) is adapted and clamped on an inner side of the limiting flange (8); and the anti-slip convex strip (9) is clamped with an outer side wall of one end of the clamping convex ring (3).

* * * * *